US008253332B2

(12) United States Patent
Yasuda et al.

(10) Patent No.: US 8,253,332 B2
(45) Date of Patent: Aug. 28, 2012

(54) EXCIMER LAMP

(75) Inventors: Makoto Yasuda, Tokyo (JP); Go Kobayashi, Nagano (JP)

(73) Assignee: ORC Manufacturing Co., Ltd., Tokyo (JP)

( * ) Notice: Subject to any disclaimer, the term of this patent is extended or adjusted under 35 U.S.C. 154(b) by 81 days.

(21) Appl. No.: 12/879,103

(22) Filed: Sep. 10, 2010

(65) Prior Publication Data

US 2011/0156581 A1 Jun. 30, 2011

Related U.S. Application Data

(63) Continuation of application No. PCT/JP2009/054232, filed on Feb. 27, 2009.

(30) Foreign Application Priority Data

Mar. 14, 2008 (JP) ..... 2008-065311

(51) Int. Cl.
*H01J 17/20* (2012.01)

(52) U.S. Cl. ..... 313/572; 362/263
(58) Field of Classification Search ..... 313/607, 313/234, 572; 362/263; 315/248
See application file for complete search history.

(56) References Cited

U.S. PATENT DOCUMENTS

2009/0039757 A1* 2/2009 Ohshima et al. ..... 313/484

FOREIGN PATENT DOCUMENTS

| | | |
|---|---|---|
| JP | 03-025850 | 2/1991 |
| JP | 05-275067 | 10/1993 |
| JP | 05-090803 | 12/1993 |
| JP | 08-096748 | 4/1996 |
| JP | 3170952 | 3/2001 |
| JP | 2003-217505 | 7/2003 |
| JP | 2007-234327 | 9/2007 |
| JP | 2007-324034 | 12/2007 |
| WO | 2006/114988 | 11/2006 |

* cited by examiner

*Primary Examiner* — Nimeshkumar Patel
*Assistant Examiner* — Mary Ellen Bowman
(74) *Attorney, Agent, or Firm* — Greenblum & Bernstein, P.L.C.

(57) ABSTRACT

An excimer lamp has a single tubular discharge chamber configured to enclose a discharge gas that is a noble gas or a mixing gas consisting of a noble gas and a halogen gas; a pair of electrodes configured to be arranged along opposite sides of the exterior surface of the discharge chamber; and an outer tube configured to cover the discharge chamber and the electrodes. Excimer molecules are produced by either dielectric barrier discharge or capacitive-coupled high-frequency discharge. An interior of a space formed between the outer tube and the discharge chamber is either in a vacuum state that is necessary and sufficient for preventing discharge, or is filled with an arc-suppression gas.

6 Claims, 4 Drawing Sheets

EXCIMER LAMP

CROSS REFERENCE TO RELATED APPLICATIONS

This is a continuation application of PCT Application No. PCT/JP2009/054232, filed on Feb. 27, 2009, designating the United States of America, the disclosure of which, including the specification, drawings, and claims, is incorporated herein by reference in its entirety.

The disclosure of Japanese Patent Application No. 2008-065311, filed on Mar. 14, 2008, including the specification, drawings, and claims, is further incorporated herein by reference in its entirety.

BACKGROUND OF THE INVENTION

1. Field of the Invention

The present invention relates to an excimer lamp as an ultraviolet light source that is mainly used for industry. Especially, it relates to a structure of an excimer lamp that radiates an excimer ray by either dielectric barrier discharge or capacitively-coupled high-frequency discharge.

2. Description of the Related Art

As an excimer lamp for industry, a xenon lamp having a wavelength of 172 nm is known, and is used for cleaning a substrate. An excimer lamp with a dual-cylinder tubular structure is generally used, and a light-emitting part of the lamp is formed by two co-axially cylindrical long tubes that extend along the axial direction.

For example, an excimer lamp enclosing xenon gas is used for the dry-cleaning of an LCD panel substrate, as described in Patent Document No. 1 (Japanese Patent No. 3170952). In this case, a substrate to be illuminated moves on a conveyor belt at a constant speed, and a lamp is arranged slightly above the substrate and in a direction perpendicular to a conveyer-flow direction. Since the substrate moves at a constant speed while the lamp illuminates the entire width of the substrate, the cleaning process for the whole of the substrate can be carried out uniformly. Also, in the semiconductor manufacturing field, there are many cases in which a surface process for a semiconductor wafer surface, such as a surface coating, surface modification, etc., is carried out by using an ultraviolet ray in each manufacturing step. An ultraviolet ray, such as an excimer ray having a wavelength of 172 nm based on xenon gas, or an excimer ray having a wavelength of 222 nm based on krypton and chlorine gases, is used in many of the cases.

In the dual-cylinder tubular type of excimer lamp using dielectric barrier discharge as described in the above Document 1, one of the electrodes is provided on an inner surface of an inner-side tube, and the other electrode is provided on an outer surface of an outer-side tube. The dielectric barrier discharge occurs in a discharge space between the inner-side tube and the outer-side tube by applying a high-frequency voltage of several kilo-volts between the electrodes. At this time, there is a possibility of an electrical breakdown and a creeping discharge along a discharge chamber surface, because of the application of several kilo-volts between the electrodes. It is necessary to create a sufficient amount of distance between both edge portions of the discharge chamber and the electrode edge portions or to add an electrical insulator to the discharge chamber edge portions in order to prevent the creeping discharge. However, such a construction cannot realize a compact and simple luminous unit since the conventional excimer lamp with the dual-cylinder tube structure is necessarily large.

On the other hand, as described in the Patent Document 2 (JP05-090803U), a fluorescent lamp (an outer-electrode type fluorescent lamp) in which electrodes are arranged on opposite sides of the exterior or outer surface of a single-cylinder tubular type discharge chamber is also known. In Document 2, the electrodes are covered with a coating layer consisting of a heat-proof material such as a glass bulb or ceramics, in order to prevent a creeping discharge and to enhance safety during the use of the lamp.

Even if the single-cylinder tubular type fluorescent lamp described in Document 2, which allows the diameter to be narrow, is used, a creeping discharge can still occur when a high voltage is applied to the electrodes. Since the single-cylinder tubular type of fluorescent lamp has a structure in which band-shaped electrodes are provided on an outer surface of a tube along the axis of a tubular discharge chamber, a design that lengthens an interval between the electrodes arranged along the outer surface can not be adopted. Therefore, it is necessary to cover the discharge chamber and the electrodes with an insulation material in order to prevent a creeping discharge.

To emit an excimer ray having high-radiation output characteristics, a gas pressure should be set at a high pressure (and especially an applied voltage should be set to a high voltage), however, a measure or step that only covers the electrodes with an insulation material will not cause reliability to improve. In the fluorescent lamp described in Document 2, since the pressure of a sealed gas may be set to a low level, it is not necessary to strengthen the resistance to insulation very much, even though the amount of excimer-molecules produced during a discharge is minimal and emitted light is weak. On the other hand, in an excimer lamp that applies high voltage to obtain high output of emitted light, there is a possibility of electric breakdown occurring through a slight clearance between the discharge chamber and the coating layer, though an electrode coating layer consisting of glass is heated and tightly attached to the electrodes. For example, when an aluminum foil is used as an electrode, it is difficult to coat the electrode in accordance with the electrode-shape without a clearance since the temperature of the heated glass cannot be increased sufficiently due to the low melting point of aluminum. Also, if the thermal expansion coefficient is different between the discharge chamber and the coating layer, stress occurs due to thermal hysteresis based on a blinking of the lamp, so that there is a danger that slight cracks leading to an electric breakdown may gradually occur in a boundary surface. Also, when laminating or covering by methods such as thermal spraying of glass materials, bubbling and cracking occur, which creates the danger of an electric breakdown occurring due to the bubbling and cracking. In this way, in the excimer lamp using the conventional single-cylinder tubular discharge chamber, a sufficient high voltage can not be applied, and a lamp with only low-radiation output characteristics is realized.

SUMMARY OF THE INVENTION

An object of the present invention is to provide an excimer lamp that has high reliability and prevents a creeping discharge even though a high voltage is applied to obtain a high emission output.

An excimer lamp according to the present invention has a single tubular discharge chamber configured to enclose a discharge gas that is a noble gas or a mixing gas consisting of a noble gas and a halogen gas; a pair of electrodes configured to be arranged along opposite sides of the exterior surface of the discharge chamber; and an outer tube configured to cover the discharge chamber and the electrodes. Excimer molecules occur from either dielectric barrier discharge or capacitively-coupled high-frequency discharge. Then, an interior of a space formed between the outer tube and the discharge chamber is in a necessary and sufficient vacuum state to prevent discharge.

An excimer lamp according to another aspect of the present invention has a single tubular discharge chamber configured to enclose a discharge gas that is a noble gas or a mixing gas consisting of a noble gas and a halogen gas; a pair of electrodes configured to be arranged along opposite sides of the exterior surface of the discharge chamber; and an outer tube configured to cover the discharge chamber and the electrodes. Excimer molecules occur from dielectric barrier discharge or capacitively-coupled high-frequency discharge. Then, an arc-suppression gas is enclosed in a space formed between the outer tube and the discharge chamber.

BRIEF DESCRIPTION OF THE DRAWINGS

The present invention will be better understood from the description of the preferred embodiment of the invention set forth below, together with the accompanying drawings, in which.

DESCRIPTION OF THE PREFERRED EMBODIMENTS

Hereinafter, the preferred embodiments of the present invention are described with reference to the attached drawings.

Figure 1:
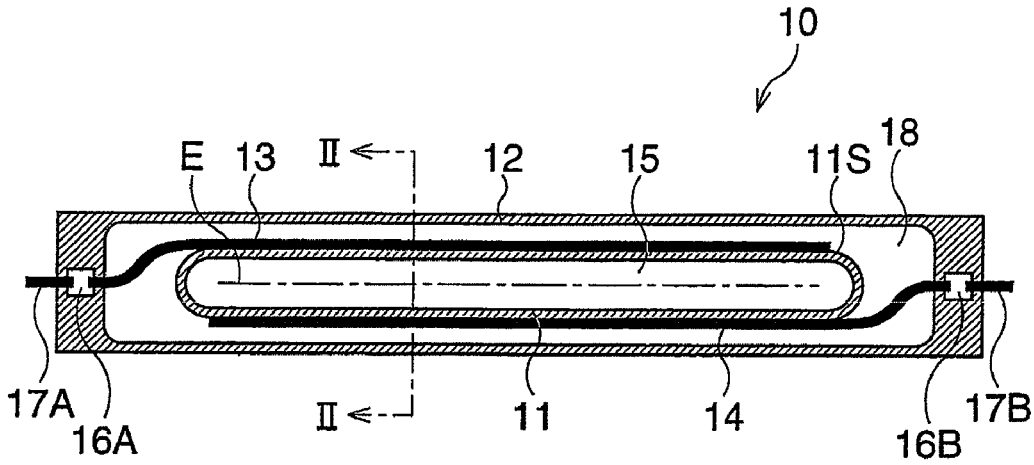
FIG. 1 is a schematic cross sectional view along an axis of an excimer lamp according to the first embodiment.
Figure 2:
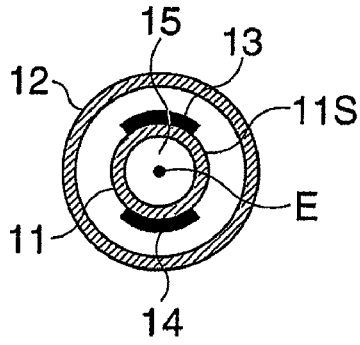
FIG. 2 is a schematic cross-sectional view along II-II shown in FIG. 1.

FIG. 1 is a cutaway side view along an axis of an excimer lamp according to the first embodiment. FIG. 2 is a schematic cross-sectional view associated with a radial direction, along II-II shown in FIG. 1.

A single-cylinder tubular excimer lamp 10 has a discharge chamber 11 consisting of quartz glass, and a cylindrical outer tube 12 consisting of quartz glass is coaxially provided so as to encompass or enclose all of the discharge chamber 11. A circular cylindrical space 18 (hereinafter called an "insulation space") is formed between the discharge chamber 11 having hemispherical edge portions and the outer tube 12. A discharge gas that produces excimer molecules during discharge, such as xenon gas, is filled or enclosed in a discharge space 15 formed in the discharge chamber 11.

On the outer surface (exterior side surface) 11S of the discharge chamber 11, a pair of band-shaped electrodes 13 and 14, which extend along the lamp axis E, are arranged so as to be opposite one another, and the arrangement is symmetrical with respect to the lamp axis E. The electrodes 13 and 14, which are formed by a metal plate such as a molybdenum (Mo), are fixed tightly to the outer surface 11S, and extend to Mo foils 16A and 16B, respectively, which are provided within the wall of the outer tube 12.

Lead wires 17A and 17B that extend to the outside of the lamp 10 are connected to the Mo foils 16A and 16B, respectively. Thus, the discharge chamber 11 is electrically connected to the outside of the excimer lamp 10 and electric power is supplied from an alternating high-voltage power supply source (not shown), which is provided outside of the excimer lamp 10, to the electric chamber 11 via the lead wires 17A and 17B.

A lamp manufacturing method for connecting electricity between the inside and the outside of the lamp via the Mo foils 17A and 17B is conventionally well known, and a pinch seal is formed at the Mo foils 17A and 17B to maintain a hermetically sealed interior. In the insulation space 18 formed between the discharge chamber 11 and the outer tube 12 that encompasses the discharge chamber 11 and the electrodes 13 and 14, an insulative gas and/or arc-suppression gas such as $SF_6$ is enclosed.

When a high-voltage having a alternating rectangular pulse is applied across the electrodes 13 and 14 by the alternating high-voltage power supply source, a dielectric barrier discharge occurs in the discharge space 15 formed in the discharge chamber 11. Xenon excimer light (ultraviolet ray) having the wavelength of 172 nm, which is generated by dielectric barrier discharge, passes through the discharge chamber 11, the electrodes 13 and 14, and through the outer tube 12 so that the excimer light is emitted outside. Note, when a mixing gas composed of a krypton gas and a chlorine gas fills in the discharge chamber 11 as a discharge gas, excimer light having the wavelength of 222 nm is emitted.

The insulative gas or arc-suppression gas is enclosed in the insulation space 18 formed between the electrodes 13 and 14, which are arranged on the outer surface of the discharge chamber 11, and the outer surface 12. Then, the outer tube 12 seals the inside of the outer tube 12. Thus, even if high-voltages such as several kilo-voltages are applied to the electrodes 13 and 14 of the excimer lamp 10 that is equipped with the single-cylinder tubular discharge chamber 11, an occurrence of creeping discharge is prevented since the electrodes 13 and 14 are securely insulated from the exterior of the lamp. The volume of insulation space 18 may be determined so as to securely prevent a discharge, and it may be small in accordance with a requirement to allow the lamp to be compact.

Also, since the insulative gas is filled in the insulation space 18, the level of insulation is enhanced and the temperature of the lamp decreases through a heat conduction and convection. Thus, the electrodes are protected from an oxidation caused by high temperature.

Next, an excimer lamp according to the second embodiment is explained with reference to FIG. 3. In the second embodiment, the material of the outer tube is different from that according to the first embodiment. Other constructions are substantially the same as those in the first embodiment, and the same reference numbers are designated for the same constructions.

Figure 3:
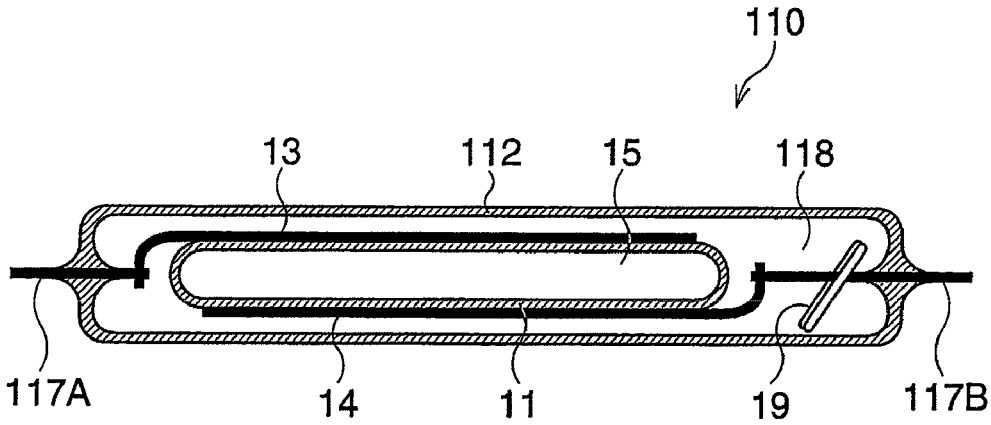
FIG. 3 is a schematic cross sectional view of an excimer lamp according to the second embodiment.

FIG. 3 is a cutaway side view of an excimer lamp according to the second embodiment. The excimer lamp 110 has a quartz glass discharge chamber 11 and an outer tube 112 composed of hard glass such as a tungsten glass. The hard glass has a heat expansion coefficient higher than that of the quartz glass, and metal lead wires 117A and 1178, such as tungsten wires, are connected to electrodes 13 and 14, and directly enclosed within the outer surface 112.

An insulation space 118 formed between the discharge chamber 11 and the outer surface 112 is subjected to be vacuum state. To form a vacuum space, gas in the discharge chamber 11 is first exhausted through an exhaust tube (not shown) provided on the outer surface 112 by utilizing a turbomolecular pomp such that high vacuum state is produced, and the exhaust tube is then shut. Next, a barium getter 119 is scattered and adhered to the inner wall of the outer surface 112 by a high-frequency induction heating. Thus, the few impure gases that were left over inside of the outer tube 112 are absorbed by the getter and the inner space of the outer tube 112 reaches a vacuum state necessary for and sufficient for preventing a discharge such as a creeping discharge from occurring. Note that a zirconium getter may be used instead of the barium getter. In this case, no scattered material occurs even though high-frequency induction heating is carried out, and emitted light is not shielded.

A discharge gas that fills the discharge space 15 formed in the discharge chamber 11 is herein a mixing gas composed of a xenon gas and a chlorine gas, therefore, excimer light having the wavelength of 308 nm is emitted from the discharge chamber 11 in a radial direction and is directed to the outside of the lamp 10 while passing through the hard glass outer tube 112. The outer tube 112 made from the hard glass allows the discharge chamber 11 and the exterior of the lamp 10 to form an electrical connection with one another without the use of an Mo foil, and a lamp with high reliability can be manufactured at a low cost. Also, the vacuum space prevents oxidation when the electrodes reach a high temperature.

Next, an excimer lamp according to the third embodiment is explained with reference to FIG. 4. In the third embodiment, the material of the discharge chamber is different from that according to the first embodiment. The other constructions are substantially the same as those in the first embodiment.

Figure 4:
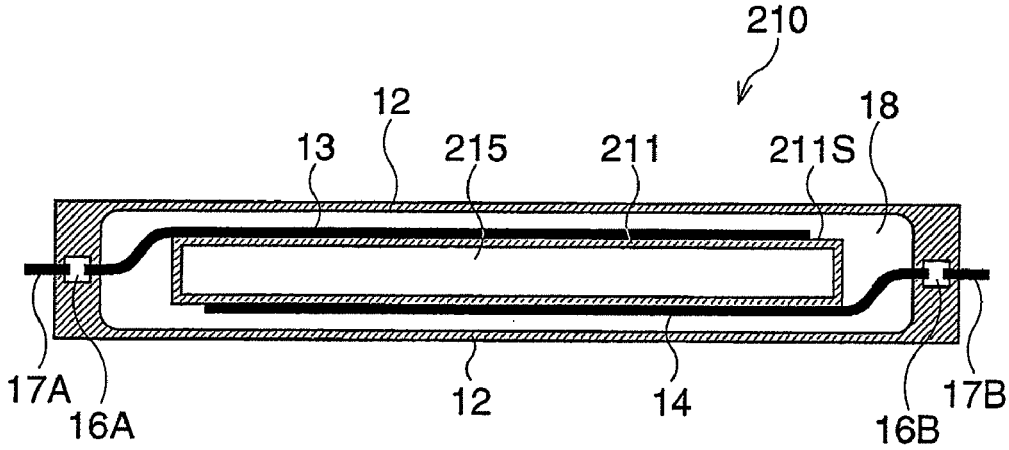
FIG. 4 is a schematic cross sectional view of the excimer lamp according to the third embodiment.

FIG. 4 is a cutaway side view of the excimer lamp according to the third embodiment. A discharge chamber 211 in the excimer lamp 210 is composed of ceramics such as alumina, and electrodes 13 and 14 are arranged on the outer surface 211S so as to be opposite from one another. In the insulation space 18 formed between the discharge chamber 211 and the quartz glass outer tube 12, an arc-suppression gas such as a mixing gas consisting of $N_2$ and $O_2$ is enclosed. Thus, creeping discharge in the outer tube 12 is prevented.

Since the discharge chamber 211 is made of ceramics with heat resistance and relatively high strength, an input voltage can be increased, so that the intensity of light increases, thereby increasing the service life of use for the lamp. Furthermore, a gas reacting with a quartz discharge chamber, such as a fluorine gas, may be enclosed in the discharge space 215. Thus, excimer light having a specific wavelength, which is not obtained from the quartz discharge chamber, can be emitted.

Next, an excimer lamp according to the fourth embodiment is explained with reference to FIGS. 5 and 6. In the fourth embodiment, an outer tube and a discharge chamber are partially integrated in a section along an axial direction in which a pair of electrodes is arranged. The other constructions are substantially the same as those in the first and second embodiments.

Figure 5:
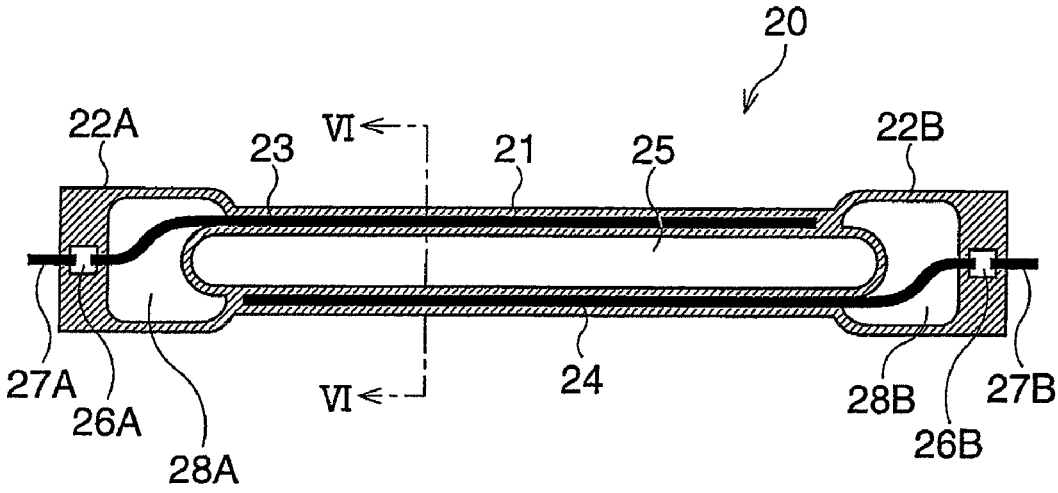
FIG. 5 is a schematic cross sectional view along an axis of an excimer lamp according to the fourth embodiment.

FIG. 5 is a cutaway side view along the axis of an excimer lamp according to the fourth embodiment. FIG. 6 is a schematic cross-sectional view along VI-VI shown in FIG. 5.

An excimer lamp 20 has a quartz glass discharge chamber 21, and both ends of the lamp 20 along the axial direction are covered with outer tubes 22A and 22B, respectively. Electrodes 23 and 24 are mounted or buried into the wall of the discharge chamber 21, and are arranged along the exterior surface of the chamber 21 directly across from each other (see FIG. 6). The electrodes 23 and 24 are connected with lead wires 27A and 27B via Mo foils 26A and 26B, respectively. A noble gas for discharge is enclosed in a discharge space 25 formed in the discharge chamber 21. On the other hand, insulation spaces 28A and 28B formed between the outer tubes 22A and 22B are in a vacuum state.

A manufacturing method for the excimer lamp 20 that integrates the discharge chamber with the outer tube at the electrode-arranged portion is as follows. First, two quartz tubes having different diameters are prepared, and one tube having a relatively smaller diameter is inserted into the other tube having a relatively larger diameter. Then, electrodes such as Mo foils are inserted between the two quartz tubes so as to be opposite one another. When heating the outer surface of the large-diameter quartz tube along the axial direction while decompressing a gap between the two tubes, the thick-diameter quartz tube deforms and tightly adheres to the thin-diameter quartz tube.

By continuing to heat the outer surface, the parts other than the electrode-arranged portion are perfectly melted, so that the discharge member 21 integrated from the two quartz tubes is formed. Namely, the lamp 10 is such that the outer tubes cover or encompass the discharge chamber and the electrodes while adhering to each other. Note that the outer tubes 32A and 32B are connected to an exhaust tube and are subjected to an exhaust process to create a vacuum in the insulation spaces 28A and 28B.

Figure 6:
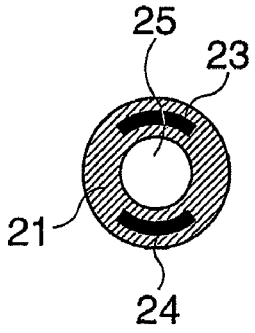
FIG. 6 is a schematic cross-sectional view along VI-VI shown in FIG. 5.

As shown in FIG. 6, the electrodes 23 and 24 are buried in the wall of the discharge chamber 21, and the quartz tube that had a relatively large diameter at the outset of the manufacturing process configures radially to the outer parts relative to the electrodes 23 and 24, whereas the quartz tube that had a relatively small diameter configures radially to the inner parts relative to the electrodes 23 and 24. On the other hand, the end portions of the bold-diameter quartz tube, which were not heated or adhered, configure to the outer tubes 22A and 22B that cover the end portions of the discharge chamber 21, thus Mo foils 26A and 26B are sealed in the outer tubes 22A and 22B.

In this way, an emitting portion of the lamp is a single tubular structure by mounting the electrodes 23 and 24 within the wall of the discharge chamber 21, so that a loss of light on the outer tube surface does not occur at incidence or emission, and the efficiency of light transmission increases. Also, even if a slight gap occurs due to heat stress at the melted portion of the discharge chamber 21 that is formed by the large-diameter quartz tube and the small-diameter quartz tube, the gap is maintained in a vacuum state since the end portions of the discharge chamber 21 are covered with the outer tubes 22A and 22B. Therefore, electrical breakdown based on the gap does not occur at the electrode-arranged portion even though a high-voltage is applied to the electrodes.

Next, an excimer lamp according to the fifth embodiment is explained with reference to FIG. 7. In the fifth embodiment, the excimer lamp emits light in the axial direction. Other components are substantially the same as those in the fourth embodiment.

Figure 7:
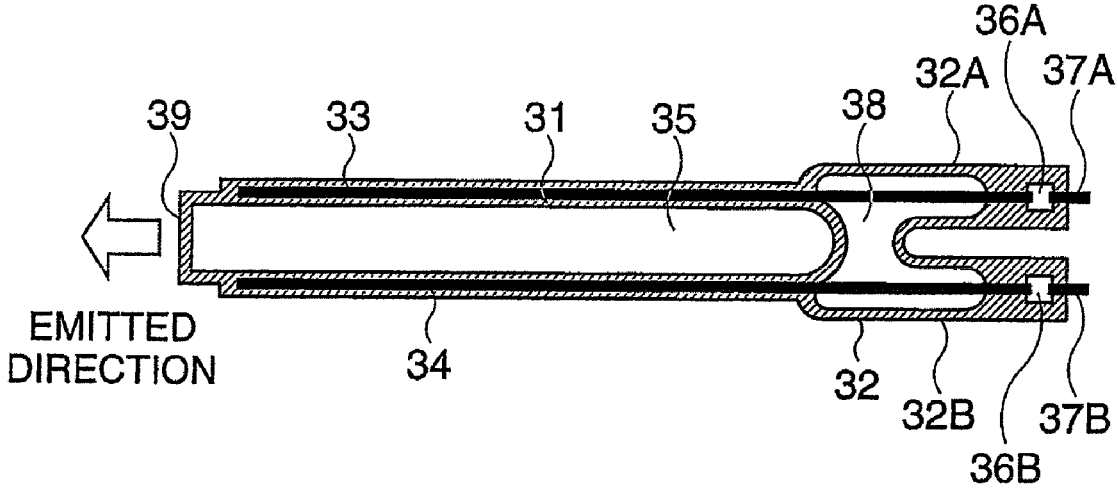
FIG. 7 is a schematic cross sectional view according to the fifth embodiment.

FIG. 7 is a cutaway side view according to the fifth embodiment. An emission window 39 is formed at the end portion of a quartz discharge chamber 31, and the other end portion is covered with an outer tube 32. The outer tube 32 is composed of forked tubes 32A and 32B, and an arc-suppression gas, such as a mixing gas consisting of $N_2$ and $SF_6$ is enclosed in an insulation space 38 formed between the discharge chamber 31 and the outer surface 32.

Electrodes 33 and 34 are buried in the wall of the discharge chamber 31 so as to be opposite one another, and respective ends of the electrodes extend to the forked tubes 32A and 32B. Then, electrodes 33 and 34 are connected to lead wires 37A and 37B via Mo foils 36A and 36B, respectively. The forked tubes 32A and 32B are positioned sufficiently apart from the lead wires 37A and 37B by a given insulation distance to prevent an electric breakdown from occurring. A noble gas is enclosed in the discharge chamber 35. Note that, since a process for connecting a thick-diameter quartz tube with a thin-diameter quartz tube during the manufacture of the outer tube 32 is a normal glass process and the manufacturing method of the lamp that uses Mo foils at the end portion is well known as described in the first embodiment, the explanations are herein omitted.

An excimer ray generated by dielectric barrier discharge is emitted through the emission window 39. Since an excimer ray does not have self-absorption, strong light is obtained from a series of emissions that occurs in the long discharge range along the axial direction. Also, light can be emitted to the exterior without the influence of shielding by the electrodes 33 and 34.

As for the first to fourth embodiments, a fluorescent material may be coated on the inner wall of the outer-tube that is permeable to visible light, in order to transform an ultraviolet ray to visible light and emit the visible light to the outside. Thus, an excimer lamp can be utilized as an illumination lamp, and an ultraviolet ray can be transformed to light having a specific wavelength necessary for illumination. In this case, neither physical damage of the discharge chamber due to contact with plasmas generated by the dielectric barrier discharge, nor degradation of the discharge chamber due to increased heat occurs since a fluorescent material is not coated on an inner surface of the discharge chamber, which is different from a conventional outer-electrode type fluorescent lamp. Therefore, the pressure of a gas such as xenon gas, which is sealed in the discharge chamber, can be set to a high pressure, and a high voltage can be applied to the electrodes.

As the discharge method, the capacitively-coupled high-frequency discharge method, which uses a relatively low-voltage and is used for a lamp used for scanning, may be applied instead of the above-mentioned dielectric barrier discharge method. In the dielectric barrier discharge type excimer lamp, discharges occur uniformly and stably even though a discharge distance of a discharge space may be long, so that an excellent illumination distribution can be realized along the lamp axis. On the other hand, in the case of the capacitively-coupled high-frequency discharge lamp, a high-voltage can be applied to electrodes by providing an LC resonance circuit at the final portion of an electric supply source.

An arbitrary gas may be enclosed in a discharge space, for example, a mixing gas consisting of an argon gas and a fluorine gas are enclosed in the discharge space to emit light having wavelength of 193 nm. Also, a protection membrane, such as an alumina membrane, a titanium membrane, magnesium membrane, and etc., may be formed on the inside surface of the discharge chamber in order to protect against weakening of the discharge chamber glass and to prevent a reaction between the glass and an enclosed gas. When enclosing a gas including halogen gas, a fluorine magnesium membrane may be formed. Also, a single gas or mixing gas including insulative gas and/or arc-suppression gas, which is the same as a gas(es) enclosed in the insulation space, may be enclosed in the discharge chamber. For example, a singe/mixing gas including at lease one selected from $N_2$, CO, $CO_2$, $SF_6$, and $CF_4$ may be used as an enclosed gas.

The materials and the forms of the discharge chamber and the outer tube may be optionally designed, a specific form such as an ellipse-shaped tube or rectangular prism other than a cylindrical form may be applied, and a material that passes specific excimer light to the outside may be applied. Furthermore, a plurality of lamps may be applied instead of the above single lamp, in order to illuminate light over a broad area.

Namely, a construction that arranges an outer tube for forming an insulation space outside of a single tubular discharge chamber, which is different from a dual-tubular structure that forms a discharge space between discharge chambers, may be applied. Then, a vacuum state, which is necessary and sufficient for preventing discharge, may be created in the space formed between the outer tube and the discharge chamber. Herein, "a vacuum state that is necessary for preventing discharge and sufficient for preventing discharge" represents a vacuum state to the extent which a discharge, such as a creeping discharge, is prevented. This construction forms an insulation space around a pair of electrodes, so that a creeping discharge and a discharge due to electric breakdown in a section where lead wires connected can be are prevented.

For example, an outer tube may enclose the whole of the discharge chamber, or may be uniform in the portion where the electrodes are arranged. The partially uniform excimer lamp is, for example, used for cleaning a substrate, and may be applied as either a dielectric barrier discharge excimer lamp that generates discharge plasma through the application of high-voltage, or as a capacitively-coupled high-frequency discharge lamp such as an outer electrode type fluorescent lamp that produces a discharge from a high-frequency voltage. Also, a pair of electrodes enclosed by the outer tube is, for example, arranged on sides of the exterior surface of the discharge chamber, or may be arranged in the wall or on the side surface of the discharge chamber. As for a discharge gas, a noble gas or mixing gas that is consisting of a noble gas and a halogen gas may be applied.

A discharge chamber can be designed in accordance with excimer light having a specific required wavelength, for example, designed such that a reaction with a gas enclosed in a discharge space is prevented. Therefore, different materials may be used for the discharge chamber and the outer tube. For example, an outer tube may be made from a hard glass and a discharge chamber may be made from a quartz glass that reduce cost, or an outer tube may be made from a quartz glass and a discharge chamber may be made from ceramics in order to use a discharge gas such as fluorine gas.

To enhance the emission efficiency of excimer light, at least part of an outer tube may be uniformly welded to a discharge chamber, for example, at least part of the discharge chamber and an outer tube may be the same material, and the discharge chamber and the outer tube may be uniformly welded to one another at an electrode-arranged portion, whereas at least one end portion of the discharge chamber may be covered with the outer tube. Since the end portion of the discharge chamber is covered with the outer tube, discharge is prevented even though a gap occurs at a surface in a contact with the electrodes provided within the wall.

Also, when designing an excimer lamp as a fluorescent lamp, fluorescent materials that transmit excimer light to light having a different wavelength and that illuminate the light outside may be provided inside of the outer tube to avoid influence from a contact between discharge plasmas and the fluorescent materials.

By the above construction, creeping discharge between electrodes or an electric breakdown between lead wires that connect the electrodes to the outside is securely prevented inside of the outer tube, so that an applied voltage can be set to a sufficiently high-voltage, and a lamp having high-emission capability can be realized. Furthermore, oxidation of electrodes and lead wires in the outer tube is prevented so that a lamp with high reliability can be realized. Also, a compact, thin, and low-cost lamp can be realized since a lamp can be composed of a thin tube.

The invention claimed is:

1. An excimer lamp, comprising:

a single tubular discharge chamber configured to enclose a discharge gas that is a noble gas or a mixing gas consisting of a noble gas and a halogen gas;

a pair of electrodes configured to be arranged along opposite sides of an exterior surface of said discharge chamber; and an outer tube configured to cover said discharge chamber and said pair of electrodes, excimer molecules being produced by dielectric barrier discharge or capacitively-coupled high-frequency discharge, an interior of a space formed between said outer tube and said discharge chamber being a vacuum state that is sufficient for preventing discharge, wherein at least part of said discharge chamber and said outer tube is the same material, said discharge chamber and said outer tube being uniformly welded to one another at an electrode-arranged portion, at least one end portion of said discharge chamber being covered with said outer tube.

2. The excimer lamp according to claim 1, wherein a pressure of the discharge gas is less than or equal to 1 atm.

3. An excimer lamp, comprising:

a single tubular discharge chamber configured to enclose a discharge gas that is a noble gas or a mixing gas consisting of a noble gas and a halogen gas;

a pair of electrodes configured to be arranged along opposite sides of an exterior surface of said discharge chamber; and an outer tube configured to cover said discharge chamber and said pair of electrodes, excimer molecules being produced by dielectric barrier discharge or capacitively-coupled high-frequency discharge, an arc-suppression gas being enclosed in a space formed between said outer tube and said discharge chamber, wherein at least part of said discharge chamber and said outer tube is the same material, said discharge chamber and said outer tube being uniformly welded to one another at an electrode-arranged portion, at least one end portion of said discharge chamber being covered with said outer tube.

4. The excimer lamp according to claim 3, wherein a pressure of the discharge gas is less than or equal to 1 atm.

5. An excimer lamp, comprising:

a single tubular discharge chamber configured to enclose a discharge gas that is a noble gas or a mixing gas consisting of a noble gas and a halogen gas;

a pair of electrodes configured to be arranged along opposite sides of an exterior surface of said discharge chamber; and an outer tube configured to cover said discharge chamber and said pair of electrodes, excimer molecules being produced by dielectric barrier discharge or capacitively-coupled high-frequency discharge, an arc-suppression gas being enclosed in a space formed between said outer tube and said discharge chamber, wherein a single gas or a mixing gas that is selected from at least one of $N_2$, CO, $CO_2$, NO, $SF_6$, and $CF_4$ is enclosed in the space as an arc-suppression gas, and wherein at least part of said discharge chamber and said outer tube is the same material, said discharge chamber and said outer tube being uniformly welded to one another at an electrode-arranged portion, at least one end portion of said discharge chamber being covered with said outer tube.

6. The excimer lamp according to claim 5, wherein a pressure of the discharge gas is less than or equal to 1 atm.

* * * * *